US009774088B1

(12) United States Patent
Fischer et al.

(10) Patent No.: US 9,774,088 B1
(45) Date of Patent: Sep. 26, 2017

(54) ANTENNA SYSTEM

(71) Applicant: FISCHER CUSTOM COMMUNICATIONS, INC., Torrance, CA (US)

(72) Inventors: Allen W. Fischer, Rancho Palos Verdes, CA (US); Joseph F. Fischer, Redondo Beach, CA (US); Bruce L. Harlacher, San Diego, CA (US); Eric B. Crittenden, Torrance, CA (US); Peter G. Drembelas, Los Angeles, CA (US)

(73) Assignee: FISCHER CUSTOM COMMUNICATIONS, INC., Torrance, CA (US)

( * ) Notice: Subject to any disclaimer, the term of this patent is extended or adjusted under 35 U.S.C. 154(b) by 0 days.

(21) Appl. No.: 14/947,363

(22) Filed: Nov. 20, 2015

Related U.S. Application Data

(60) Provisional application No. 62/082,519, filed on Nov. 20, 2014.

(51) Int. Cl.
*H01Q 7/06* (2006.01)
*H01Q 1/42* (2006.01)

(52) U.S. Cl.
CPC ..... *H01Q 7/06* (2013.01); *H01Q 1/42* (2013.01)

(58) Field of Classification Search
CPC ..... H01Q 7/06; H01Q 1/42
USPC ..... 343/788
See application file for complete search history.

(56) References Cited

U.S. PATENT DOCUMENTS 6,492,956 B1 * 12/2002 Fischer ..... H01Q 7/08 343/788
2005/0088357 A1 * 4/2005 Hess ..... A61N 1/37229 343/788

* cited by examiner

*Primary Examiner* — Dameon E Levi
*Assistant Examiner* — Andrea Lindgren Baltzell
(74) *Attorney, Agent, or Firm* — Brooks Acordia IP Law, P.C.; Michael Zarrabian

(57) ABSTRACT

An embodiment of an antenna system comprising a radio frequency (RF) current-sensing and current injecting antenna device for coupling RF energy, wherein the antenna device comprises an outer conducting non-magnetic housing, a magnetic core having a central aperture, said core insulated from said housing, and a first winding wound about said core, said first winding having a first end receiving said RF energy and a second end, said first winding insulated from said housing between said first end and said second end, wherein a conductor is positioned within said aperture, and said conductor has a length of at least 0.1 wavelength of said RF energy. Wherein, in a transmitting mode said antenna device couples RF energy, created in an RF transmitter, to the conductor. In a receiving mode said antenna device couples RF energy, developed in the conductor intercepting an RF field, to the input of an RF receiver. In the transmitting mode, the first winding functions as a primary winding and the conductor functions as a secondary winding. In the receiving mode, the first winding functions as a secondary winding and the conductor functions as a primary winding.

26 Claims, 19 Drawing Sheets

ANTENNA SYSTEM

CROSS-REFERENCE TO RELATED APPLICATION

This application claims benefit under 35 U.S.C. §119(e) of U.S. Provisional Patent Application Ser. No. 62/082,519 filed on Nov. 20, 2014, incorporated herein by reference.

FIELD OF THE INVENTION

This invention relates generally to radio frequency (RF) antennas, and in particular to stealth RF antennas.

DESCRIPTION OF RELATED ART

A conventional antenna utilizes current being developed on its structure to generate a radiated radio frequency (RF) electric field. One type of antenna is a form of wire or conductor arranged in a linear configuration, such as a metallic rod. If the current distribution on such a conductor is known, then the radiation pattern and radiated power can be determined. This determination is based upon the integration of the effects from each differential element of current along the conductor.

Generally, any conductor developing an RF current can be considered an antenna and the field generated by a conductor of any length is a function of the current generated in the conductor.

The ability of an antenna or metallic structure to radiate is a function of its radiation resistance. The radiation resistance, along with the current on the antenna, is responsible for generating RF power radiating outward from the antenna.

The lower the frequency of transmissions, the longer the antenna required to properly develop a usable radiated power. Therefore, in some low frequency applications, the antenna becomes large, and difficult to mount to a nearby structure. This necessitates a significant outlay of funds for the purchase of a proper antenna and its mounting hardware.

BRIEF SUMMARY OF THE INVENTION

One embodiment of an antenna system comprises an RF current-sensing and current injecting antenna device for coupling RF energy, wherein the antenna device comprises an outer conducting non-magnetic housing, a magnetic core having a central aperture, said core insulated from said housing, and a first winding wound about said core, said first winding having a first end receiving said RF energy and a second end, said first winding insulated from said housing between said first end and said second end, wherein a conductor is positioned within said aperture, and said conductor has a length of at least 0.1 wavelength of said RF energy. Wherein, in a transmitting mode said antenna device couples RF energy, created in an RF transmitter, to the conductor. In a receiving mode said antenna device couples RF energy, developed in the conductor intercepting an RF field, to the input of an RF receiver. In the transmitting mode, the first winding functions as a primary winding and the conductor functions as a secondary winding. In the receiving mode, the first winding functions as a secondary winding and the conductor functions as a primary winding.

Embodiments further include a method of mounting an antenna device on a structure for radio frequency (RF) communication, comprising determining performance requirements for RF communication via an RF antenna device; determining physical attributes of the structure for mounting said antenna device; providing an antenna device based on said performance requirements; determining topology of the antenna device based on said physical attributes to satisfy said performance requirements; and mounting said antenna device on said structure based on said topology. The method may further comprise determining the amount of stealth desired for the antenna device on said structure; wherein determining topology of the antenna device is further based on said desired amount of stealth. In one embodiment, the antenna device comprises an RF current-sensing and current injecting antenna device for coupling RF energy to at least an electrically conductive portion of said structure, as disclosed herein.

These and other features, aspects and advantages of the present invention will become understood with reference to the following description, appended claims and accompanying figures.

DETAILED DESCRIPTION

Figure 1:
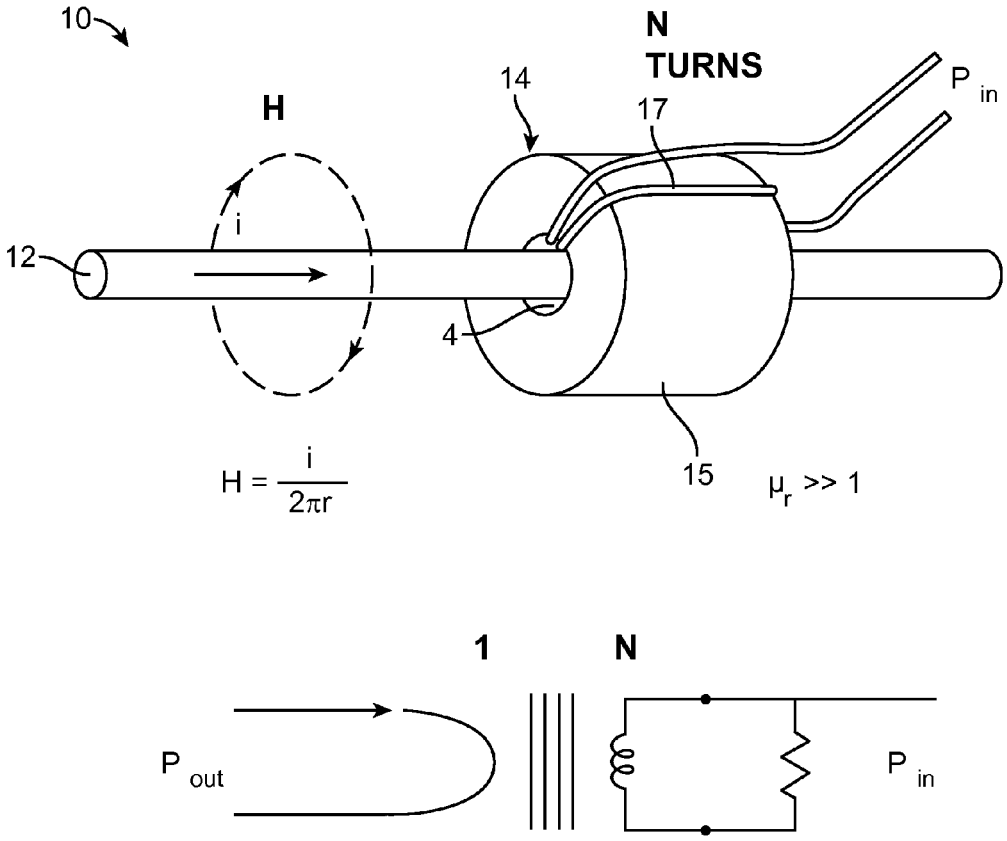
FIG. 1 shows a conceptual model of an RF antenna system, according to one embodiment of the present invention.

The following description is made for the purpose of illustrating the general principles of the embodiments discloses herein and is not meant to limit the concepts disclosed herein. Further, particular features described herein can be used in combination with other described features in each of the various possible combinations and permutations. Unless otherwise specifically defined herein, all terms are to be given their broadest possible interpretation including meanings implied from the description as well as meanings understood by those skilled in the art and/or as defined in dictionaries, treatises, etc.

Embodiments of an antenna system disclosed herein provide integrated transformer and antenna devices, and customized antennas and method of customization, to optimize performance as radio frequency transmitter and/or receiver devices while allowing disguising antenna device appearance in application for stealth.

In one embodiment, the disclosed antenna system includes an antenna device that comprises transformer apparatus for replacing conventional antennas which receive and transmit radio frequency energy from radio frequency transmitters and receivers, wherein the antenna device can be customized for application when stealth is desired. In one embodiment, the antenna device of the disclosed antenna system provides for the use of any conductor as a receiving and transmitting antenna, wherein essentially any electrical conductor or surface that is about 0.1 RF wavelengths or longer will receive or radiate RF energy.

One embodiment of the antenna device comprises an RF current-sensing and current injecting antenna device for coupling RF energy, wherein the antenna device comprises an outer conducting non-magnetic housing, a magnetic core having a central aperture, said core insulated from said housing, and a first winding wound about said core, said first winding having a first end receiving said RF energy and a second end, said first winding insulated from said housing between said first end and said second end, wherein a conductor is positioned within said aperture, and said conductor has a length of at least 0.1 wavelength of said RF energy. Wherein, in a transmitting mode said antenna device couples RF energy, created in an RF transmitter, to the conductor. In a receiving mode, said antenna device couples RF energy, developed in the conductor intercepting an RF field, to the input of an RF receiver. In the transmitting mode, the first winding functions as a primary winding and the conductor functions a secondary winding. In the receiving mode, the first winding functions as a secondary winding and the conductor functions a primary winding.

As such, the disclosed antenna system comprises an RF current injection probe for RF transmission and a current sensing instrument transformer for RF reception, as an integrated transceiver probe system.

Embodiments further include a method of mounting an antenna device on a structure for radio frequency (RF) communication, comprising determining performance requirements for RF communication via an RF antenna device; determining physical attributes of the structure for mounting said antenna device; providing an antenna device based on said performance requirements; determining topology of the antenna device based on said physical attributes to satisfy said performance requirements; and mounting said antenna device on said structure based on said topology. The method may further comprise determining the amount of stealth desired for the antenna device on said structure; wherein determining topology of the antenna device is further based on said desired amount of stealth. In one embodiment, the antenna device comprises an RF current-sensing and current injecting antenna device for coupling RF energy to at least an electrically conductive portion of said structure, as disclosed herein.

Referring to FIG. 1 as a conceptual model, in one embodiment an antenna system 10 disclosed herein comprises an electrically conducting structure 12 (e.g., a metallic structure) and an antenna device comprising a transformer 14. The transformer 14 comprises an electrical device that transfers energy between two or more electrical circuits by electromagnetic induction, as illustrated in FIG. 1, wherein H is inductance, i is RF current, $P_{in}$ is electrical power in (voltage), $P_{out}$ is power out (voltage), R is radius of conductor 12, μ is permeability of the material of the core 12.

The antenna system 10 is a coupled antenna device. In one embodiment, the transformer 14 comprises a magnetic core 15 and winding 17. In a receiving mode, the winding 17 represents a secondary winding of the transformer, and the conductor 12 passing through the center aperture 4 of the core 15, referred to as a "single turn", acts as a primary winding. The "single turn" primary can be any electrical conductor capable of carrying current. The secondary winding, when terminated by an impedance, develops a voltage across that impedance. The voltage may then be read on a voltmeter, and, since the impedance is known, the current is readily derivable. In one embodiment, the antenna system 10 is capable of coupling currents in the conductor 12 (minimum length of 0.1 wavelength) as a primary winding, over a frequency range of about 100 KHz to 3 GHz.

In one embodiment, in a transmitting mode of the antenna system as a current injecting antenna device, said winding 17 representing a primary winding of the transformer, and the conductor 12 passing through the center of the core 15 acts as a secondary winding. The RF current injecting antenna device is capable of coupling currents to said conductor over a radio frequency range. The winding 17 is driven with RF energy induced thereon by the conductor 12, over a frequency range of about 100 KHz to 3 GHz.

The transformer 14 functions as a coupling mechanism for sensing and radiating time varying electric and magnetic fields. The transformer 14 is coupled with the electrically conducting structure 12, wherein in a sensing mode (receiving mode) the transformer 14 is the secondary and in a radiating mode (transmitting mode) the transformer 14 is the primary. In one embodiment, the transformer 14 is capable of effectively coupling transmitter RF power from an RF transmitter to a wire filament or surface such as conductor 12, and creating electrical current that will cause radiated power to emanate from the wire or surface. In one embodiment, the conductor 12 is capable of effectively coupling receiver power to the transformer 14, and creating current for an RF receiver.

Figure 2:
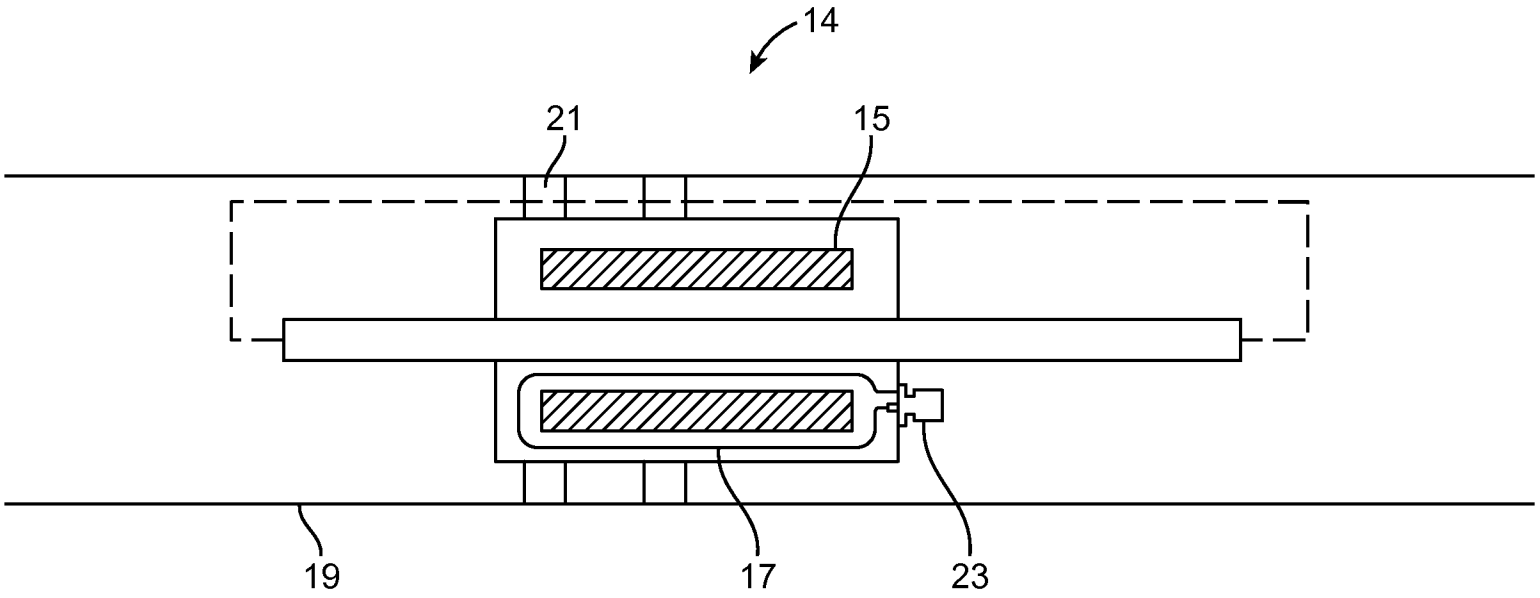
FIG. 2 illustrates an embodiment of the disclosed RF antenna system for embedding in an existing structure.

FIG. 2 illustrates an embodiment of the disclosed RF antenna system for embedding in an existing structure. FIG. 2 shows a vertical cross-section view of an embodiment of the antenna system 10 such as the antenna system shown in FIG. 2I in perspective view. FIG. 2 shows the disclosed antenna system as a coupler using a custom antenna element (e.g., dipole or loop ensemble inside dielectric roof rack structure of a vehicle substituted for existing metal roof rack structure).

Embodiments of the disclosed antenna system replace conventional antennas which transmit radio frequency energy from radio frequency transmitters. The disclosed antenna system including the antenna device transformer 14 provides for the use of any electrically conductive surface as a transmitting antenna by taking advantage of the fact that any electrical conductor or surface that is 0.1 wavelengths or longer will radiate RF energy when injected with sufficient current. The RF current injecting antenna device 14, employing the principles of an RF current probe (such as described in U.S. Pat. No. 6,492,956 issued to Applicant on Dec. 10, 2002, incorporated herein by reference), couples RF energy from a transmitter to a conductive structure or a conductive surface 12. An example frequency range demonstrated for the antenna device is about 100 kHz to 3 GHz. When RF current is injected into the electrically conducting structure 12, essentially RF energy is coupled from a transmitter into the electrically conducting structure 12 for RF transmission therefrom.

Figure 2A:
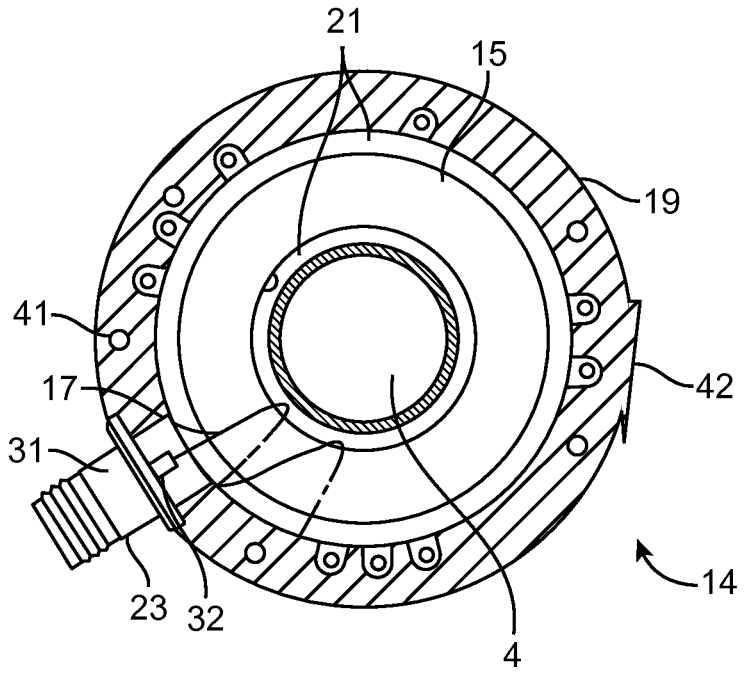
FIG. 2A shows a horizontal cross-sectional view of a toroidal core of an embodiment of the antenna system for RF current injection in an electrical conductor in a current injection mode.
Figure 2B:
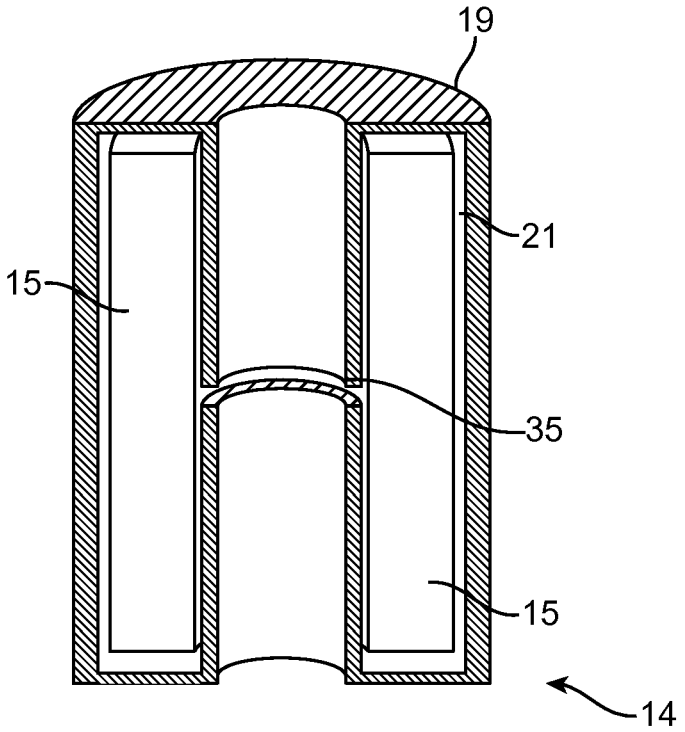
FIG. 2B shows a cross-sectional view of the toroidal core of the antenna system in FIG. 2A.

FIG. 2A shows a horizontal cross-sectional view of a toroidal core 15 of the antenna device 14 for RF current injection in an electrical conductor, according to one embodiment. FIG. 2B shows another vertical cross-sectional view of the toroidal core of the antenna device 14 for RF current injection in an electrical conductor, according to one embodiment. FIG. 2A shows a horizontal cross-section of the antenna device 14, exposing the relationship of the magnetic core 15 and its winding 17 to the non-magnetic housing 19 and an electrical connector 23. FIG. 2B shows a vertical cross-section of one half of winding of the clamp-on RF antenna device. The magnetic core 15 is split lengthwise (vertically) into two halves. FIG. 2A also shows the features that allow the transformer winding to be clamped around a conductor. A hinge 41 allows the transformer winding to be hinged open and positioned around a conductor 12. A releasable latch 42 allows the two core halves to be latched together.

In FIG. 2A, the magnetic core 15 and winding 17 are contained within a housing 19. The magnetic core 15 may comprise various magnetic core materials such as ferromagnetic materials. In one embodiment, the core 15 and winding 17 are contained within the housing 19. The core 15 may comprise various materials such as ferromagnetic alloys, amorphous ferromagnetic alloys. Examples include: Iron (Fe), Cobalt (Co), Nickel (Ni), nanocrystalline alloys, or iron based Metglas amorphous alloys.

The winding 17 maybe wound around the magnetic core 15 for a plurality of turns. The number of turns of the winding 17 and the magnetic core materials will provide different inductive and resistive characteristics, affecting the frequency response and thus the insertion loss of the device. The winding 17 may comprise a single turn around the core or several turns around the core. Typically, the winding 17 only covers one half of the core 15, but may be extended around both core halves. The winding 17 may be terminated with a connection to the housing 19 as a ground, or it can be terminated in a balanced to unbalanced transformer (typically referred to as a BALUN).

In one mode of operation, an RF signal is coupled into the transmitting transformer winding 17 through the connector 23 (FIG. 2). Typical connectors are BNC, SMA, or N-style coaxial connectors. If a coaxial connector is used, the shield 31 portion of the connector 23 is coupled to the housing, while the inside conductor 32 of the connector 23 is coupled to the winding 17. The winding 17 is terminated with a connection to the housing 19. The winding 17 and magnetic core 15 are insulated from the housing 19 by an electrical insulating layer 21. The insulating layer 21 comprises insulating materials well known in the art.

The core halves of the magnetic core 15 are generally in contact with each other when the clamp-on RF antenna device is closed, while in some instances, an intentional air gap may separate the core halves. However, even when the core halves are in contact with each other, a minute air gap may still exist even though the core faces may be polished to a very smooth finish and pressed tightly against one another (this air gap will result in air gap losses). The so-called air gap loss does not occur in the air gap itself, but is caused by the magnetic flux fringing around the gap and reentering the core in a direction of high loss. As the air gap increases, the fringing flux continues to increase, and some of the fringing flux strikes the core perpendicular to the core, and sets up eddy currents. Core materials with high resistivity will reduce these currents.

FIG. 2B shows an air gap 35 within the interior portion of the housing 19. This air gap 35 is required to prevent forming a shorted tertiary turn around the winding 17. If no air gap were present, the shorted turn of the shield would prevent the transmitting transformer first winding 17 from coupling RF current to the second winding comprising the electrical conductor 12.

As indicated above, the embodiment of the invention shown in FIGS. 2A and 2B is clamped around a conductor that is to be used as a transmitting antenna. Current flow in the winding 17 induces a magnetic field with closed flux lines substantially parallel to the core 15. This magnetic field then induces current flow in the conductor 12 clamped within the device, which results in RF energy transmission.

The performance of the antenna system in an RF current injector mode for RF transmission may be improved by using a transmission line transformer to couple the RF energy from a transmitter to the RF current injector 14. If the winding 17 is terminated to the housing 19, an unbalanced to unbalanced (UNUN) transmission line transformer is preferably used to couple RF energy to the input end of the winding 17 of the RF current injector. Alternatively, a balanced to unbalanced transformer (BALUN) may be used to couple RF energy to the RF current injector. In this configuration, the winding 17 will not be terminated at the housing 19.

Instead, both the input end and the termination of the winding 17 are connected to the balanced terminals of a BALUN. The unbalanced ends of the BALUN are connected to a coaxial cable carrying the RF energy from a transmitter. A BALUN may also be used if the RF current injector has no external shield connected to ground. Use of transmission line transformers improves impedance matching and thus minimizes losses between the transmitter and the current injector. Both BALUNs and UNUNs are well known in the art and are commercially available. However, specially made UNUNs may be required to properly match a transmitter output to the input of the RF current injector.

In a transmitting mode, the RF current injecting antenna device 14 is capable of coupling currents to said conductor 12 over a frequency range of 100 kHz to 3 GHz. The winding 17 can be driven with RF energy with a power level of up to about 0.1 to 2 Kilowatt with insertion losses of about 0.1 dB to 3 dB over a frequency range of 100 kHz to 3 GHz. In one embodiment, the antenna device can be as small as about 1 inch (2.54 cm) outer diameter for the housing 19 and 1 inch (2.54 cm) in vertical length with about 0.25 inch (0.635 cm) diameter for the core aperture 4, to about 6 inches (15.24 cm) outer diameter for the housing 19 with 10 inches (25.4 cm) in vertical length and 2 inches (5.08 cm) diameter for the core aperture 4.

In one embodiment, in a current sensing mode (instrument transformer mode) for receiving RF signals, the disclosed antenna system utilizes the detection of RF current, developed in any metallic wire, rod, bar, slab, strip, or surface, to replace a conventional antenna. The instrument transformer device 14 is an RF current sensing coupled antenna device, or, coupled antenna device. In the RF current-sensing mode of the antenna system 10, employing the principles of an instrument transformer (such as described in U.S. Pat. No. 5,633,648, issued to Applicant on May 27, 1997, incorporated herein by reference), transforms the current in a wire filament or metallic surface (e.g., conductor 12) and conveys it to an RF receiver (or RF transceiver).

In one embodiment, the antenna device 14 is capable of coupling currents in the conductor 12 (minimum length of 0.1 wavelength) as a primary winding, over a frequency range of about 100 kHz to 3 GHz. In one embodiment, the disclosed antenna device 14 extends conventional systems by allowing higher frequency to about 3 GHz. The antenna device is capable of providing a suitable signal to operate an RF receiver when the conductor 12 has a minimum length of 0.1 wavelength with measured transfer impedances varying from about 0.001 ohm to 10 ohms over the 100 kHz to 3 GHz frequency range. The magnitude of transfer impedance will provide an RF receiver to which the antenna device is connected and which has a minimum sensitivity of less than one microvolt.

The disclosed antenna system utilizes core materials for the transformer 14 that allow a wide variety of geometries, wherein the disclosed antenna system is not limited to toroidal magnetic core. Core materials with a wider range of permeability are utilized in more geometries such as rectangular, square and elliptical. As such the antenna device can have a form factor for the transformer such as rectangular, square, elliptical, etc. This allows the antenna device 14 to be disguised, for example, as an automotive roof rack.

Said wider range of permeability and geometry allow combining materials to achieve enhanced performance over specific frequency ranges and over required bandwidths (e.g., useful for signal intelligence applications). As such, embodiments of the disclosed antenna device are especially useful for signal intelligence applications, direction finding and secure communications.

In one embodiment, the antenna device comprises the transformer 14 having a toroidal core 15 with the winding 17 connected to a transmitter, and the wire or metallic structure 12 being at least 0.1 wavelengths long. The wire or metallic structure 12 can be connected directly to a metallic structure. No impedance termination or special treatment of the wire or metallic structure 12 is required. The winding 17 is wound around the toroidal magnetic core 15. This embodiment provides the capability to use metallic structures, such as guy wires, car roof racks, metal pipes, etc., as transmitting antennas. The metallic structure 12 must merely be positioned within the center aperture 4 of the core 15 of the transformer 14 and RF energy from a connected RF transmitter (e.g., RF transceiver) will be coupled from the winding 17 to the metallic structure 12 in the about 100 kHz to about 3 GHz frequency range. This embodiment also provides the capability to use the metallic structure 12 as a receiving antenna, wherein RF energy will be coupled from the metallic structure 12 to the winding 17 for receiving at a connected RF receiver (e.g., RF transceiver) in the about 100 kHz to about 3 GHz frequency range.

Figure 2C:
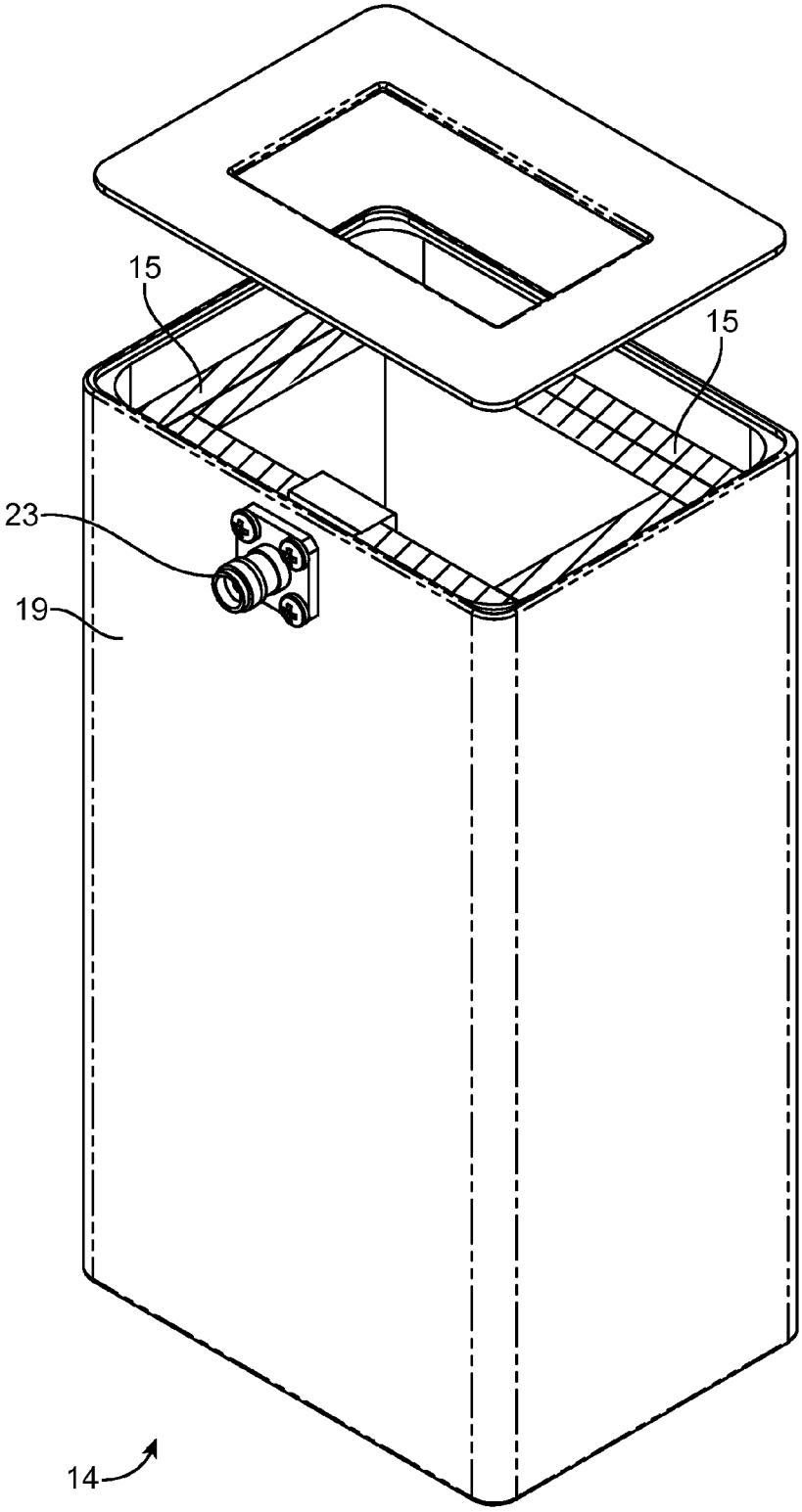
FIGS. 2C-2E show an embodiment of the disclosed antenna system with a rectangular or square magnetic core.
Figure 2D:
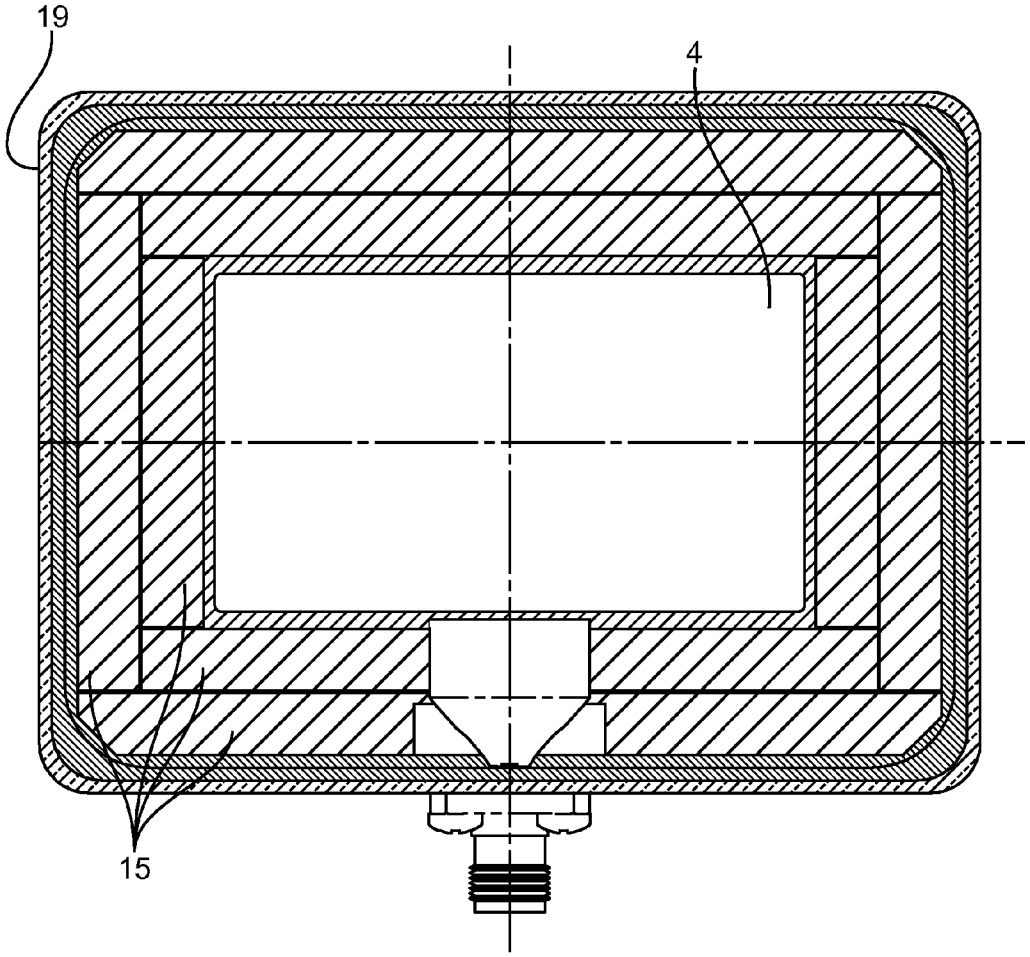
Figure 2E:
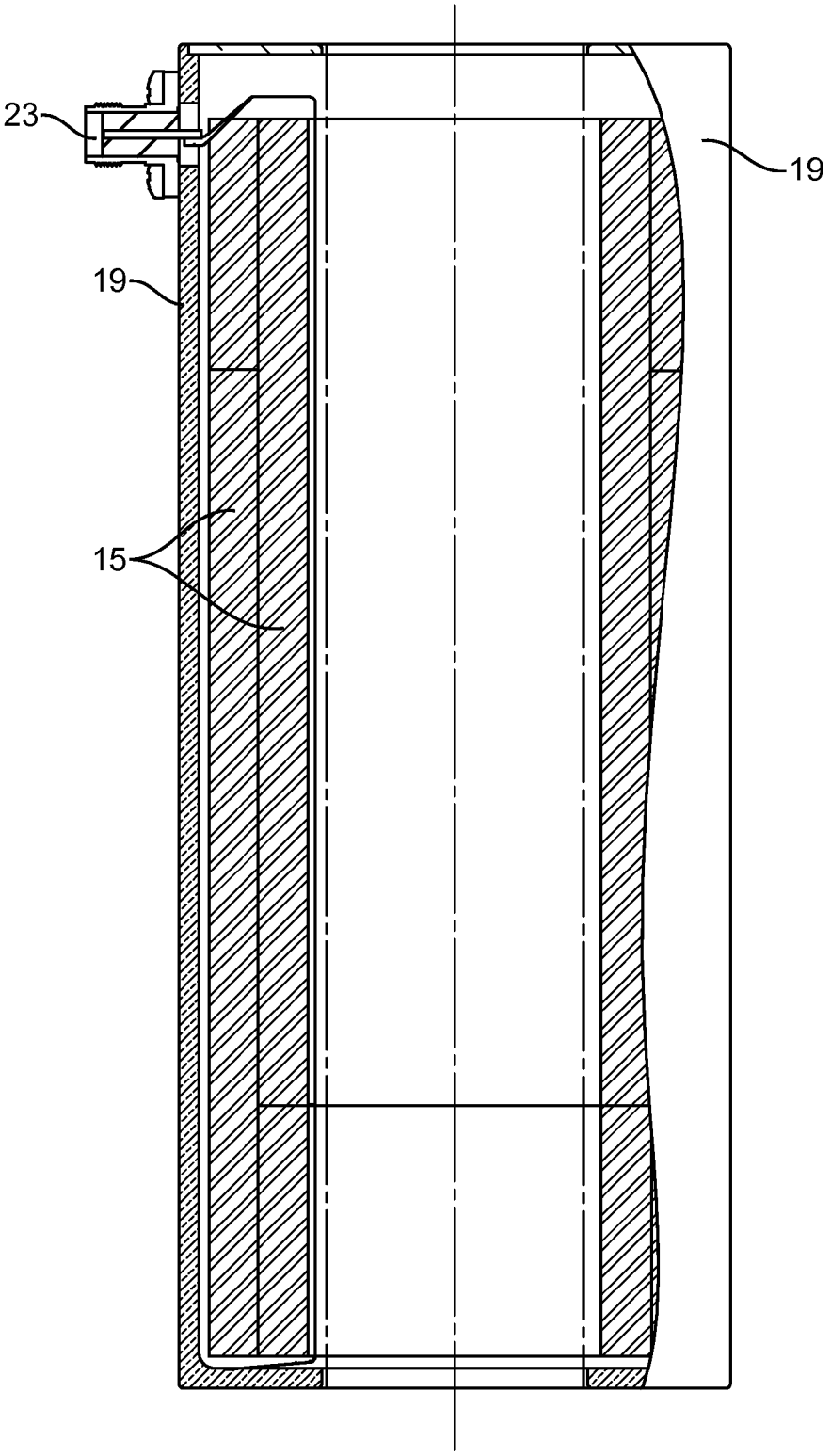

FIGS. 2C-2E show an embodiment of the disclosed antenna device 14 with a rectangular or square magnetic core 15. Specifically, FIG. 2C illustrates a perspective view of the antenna device with a cover having an aperture shown removed. FIG. 2D shows a top view of the antenna device, revealing the core configuration having multiple layered/staggered rectangular elements within the housing. FIG. 2E is a partial vertical cross-section view of the antenna device, revealing the core configuration within the housing 19.

Figure 2F:
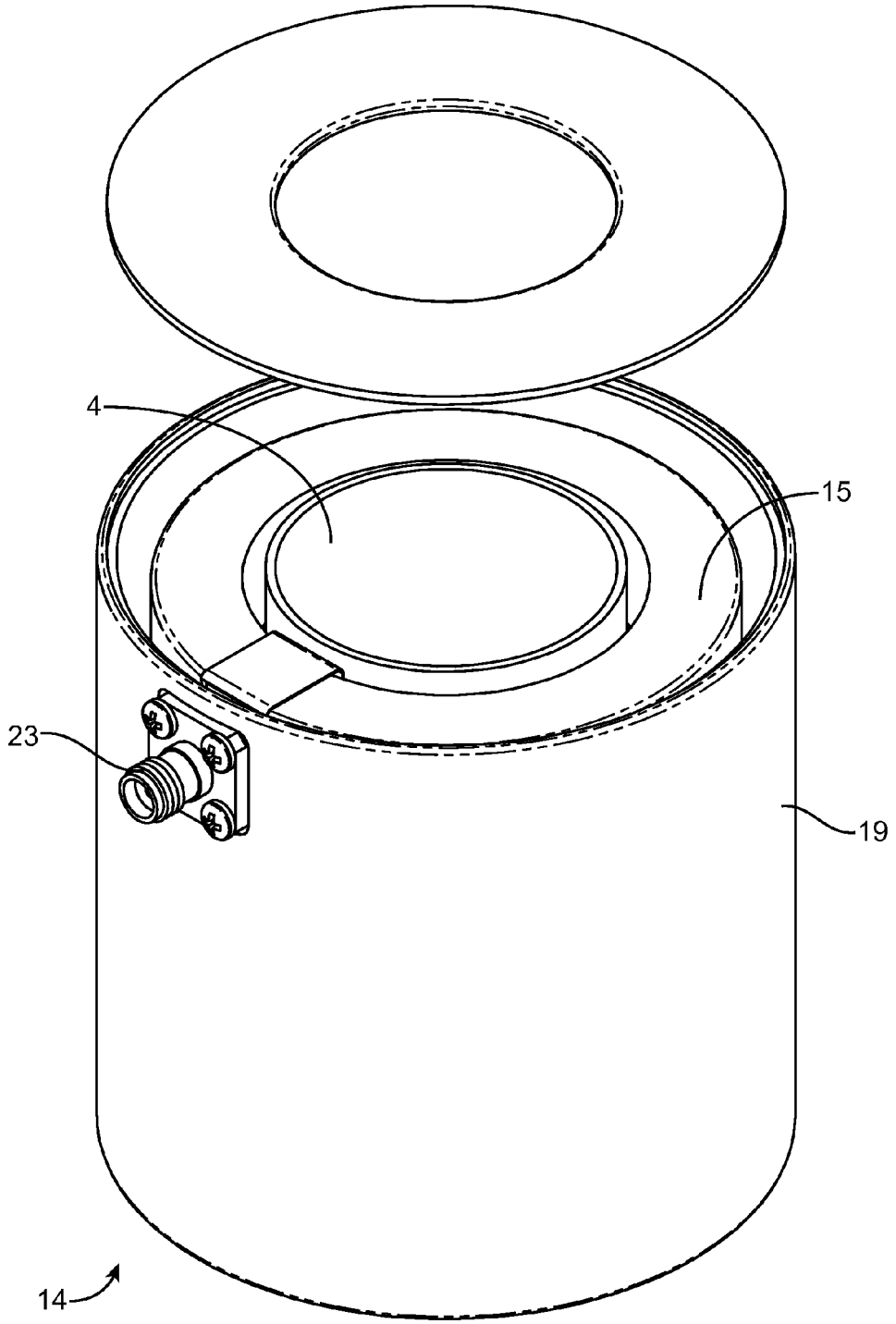
FIGS. 2F-2H show another embodiment of the disclosed antenna system with a toroidal magnetic core.
Figure 2G:
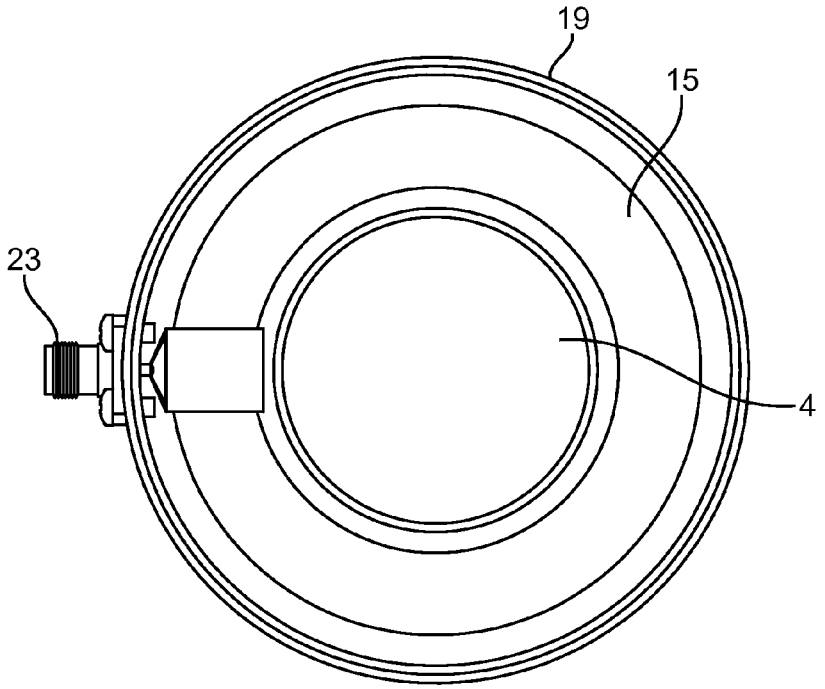
Figure 2H:
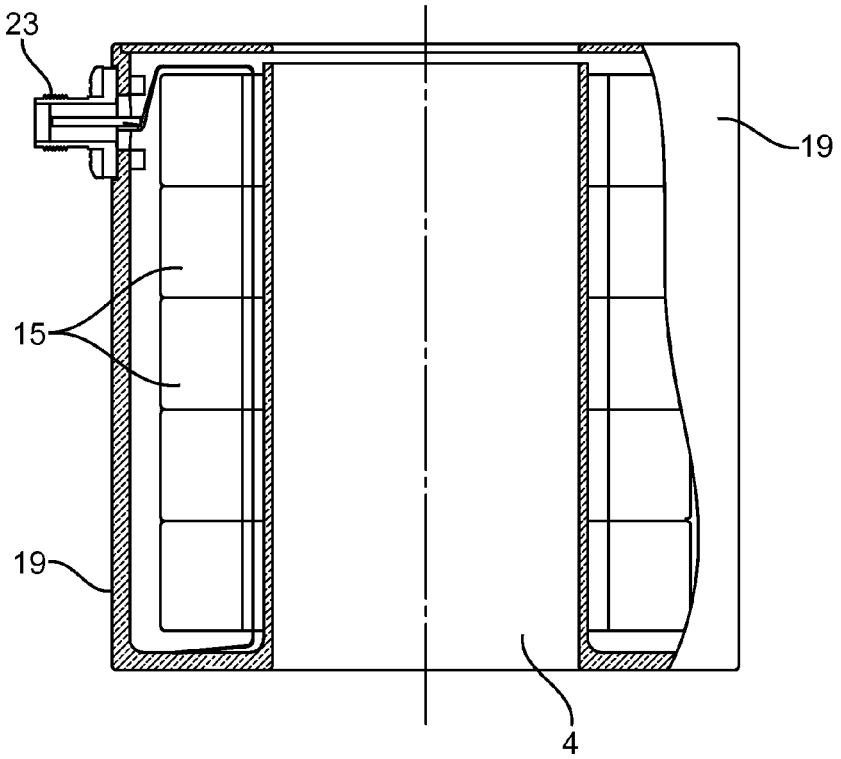

FIGS. 2F-2H show another embodiment of the disclosed antenna system with a toroidal magnetic core. Specifically, FIG. 2F illustrates a perspective view of the antenna device with an annular cover of the housing shown removed. FIG. 2G shows a top view of the antenna device, revealing the core configuration within the housing. FIG. 2H is a partial vertical cross-section view of the antenna device, revealing the core configuration including multiple (e.g., five segments) stacked annular core elements within the housing.

Figure 2I:
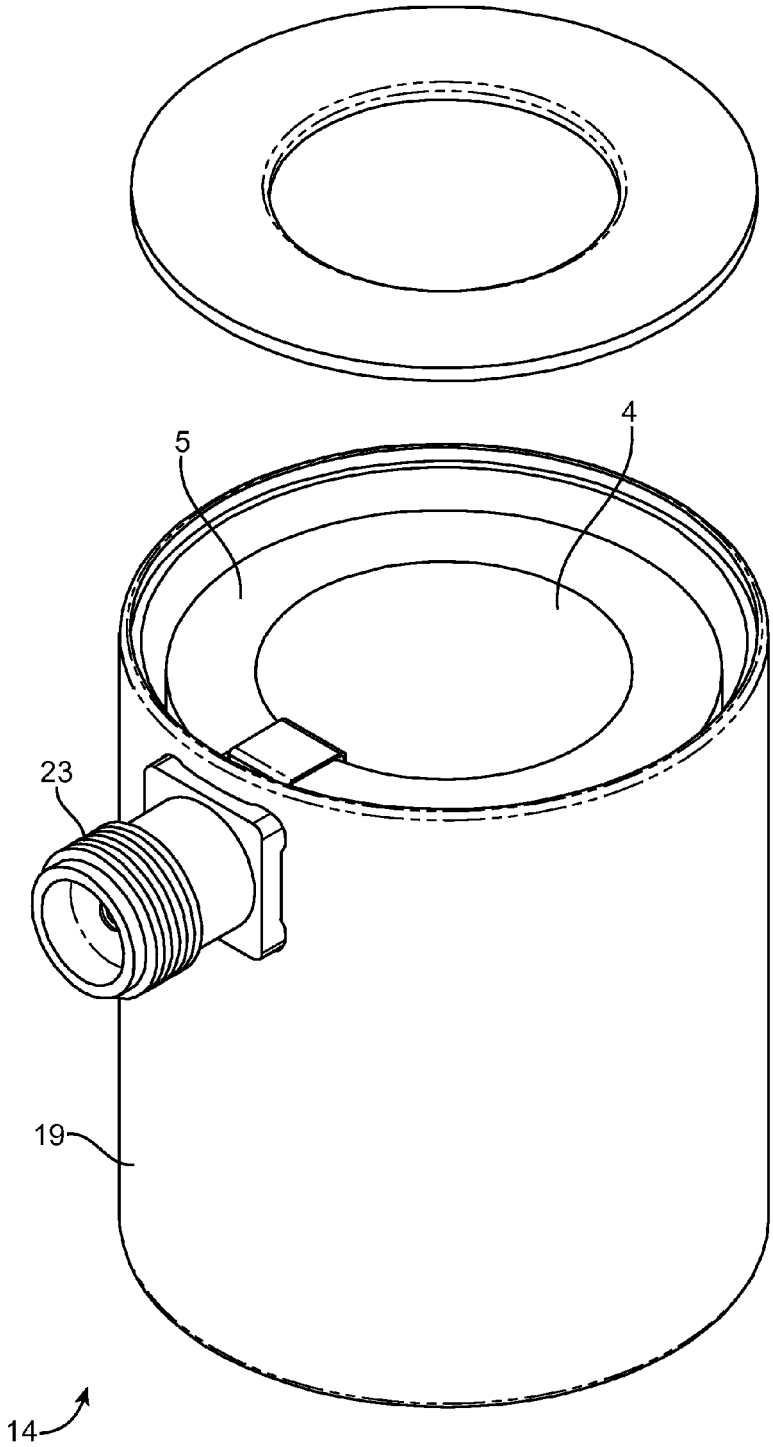
FIGS. 2I-2K show another embodiment of the disclosed antenna system with a toroidal magnetic core.
Figure 2J:
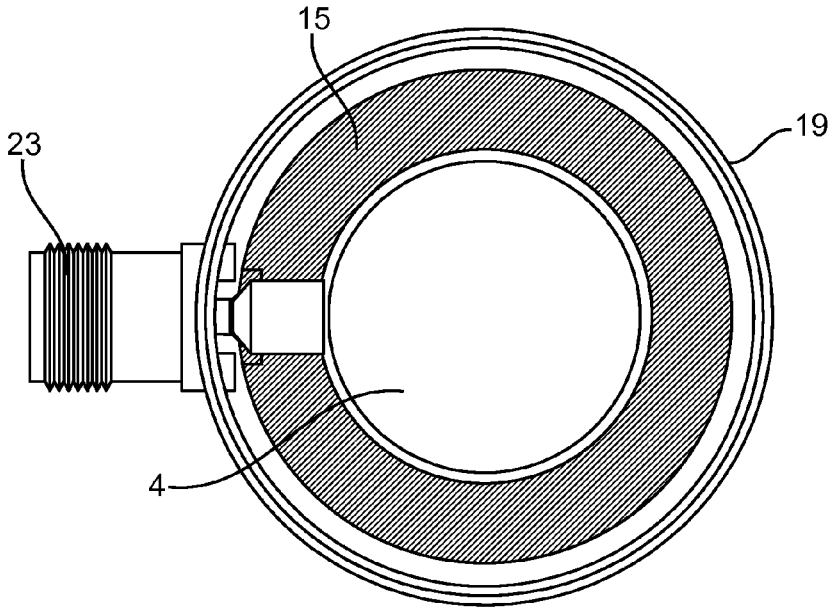
Figure 2K:
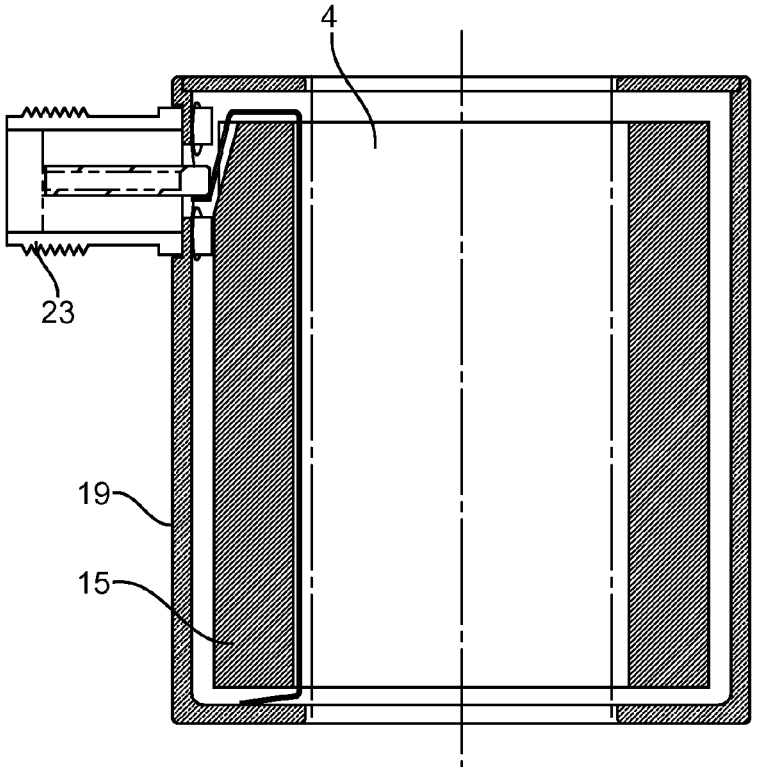

FIGS. 2I-2K show another embodiment of the disclosed antenna system with a toroidal magnetic core. Specifically, FIG. 2I illustrates a perspective view of the antenna device with an annular cover of the housing shown removed. FIG. 2J shows a top view of the antenna device, revealing the core configuration within the housing. FIG. 2K is a partial vertical cross-section view of the antenna device, revealing the core configuration within the housing.

Figure 2L:
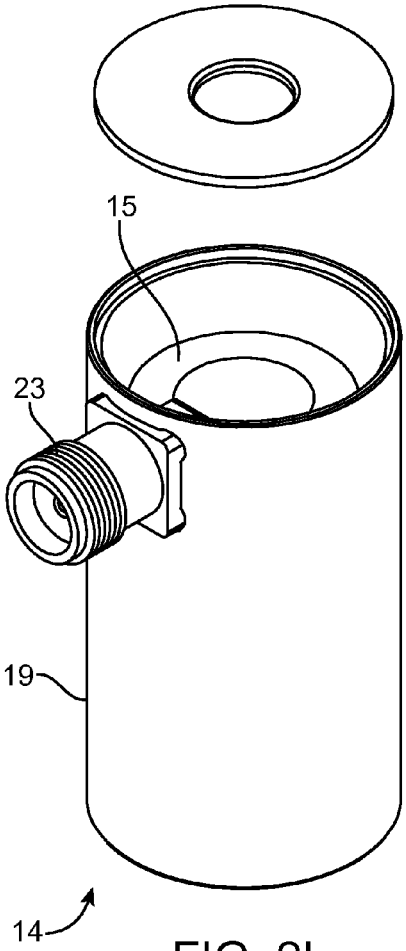
FIGS. 2L-2N show another embodiment of the disclosed antenna system with a toroidal magnetic core.
Figure 2M:
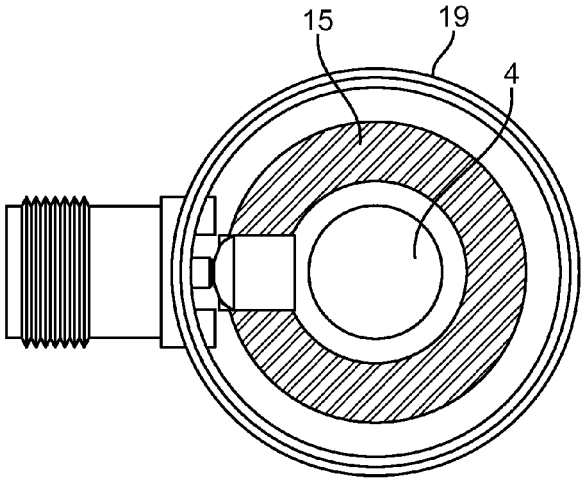
Figure 2N:
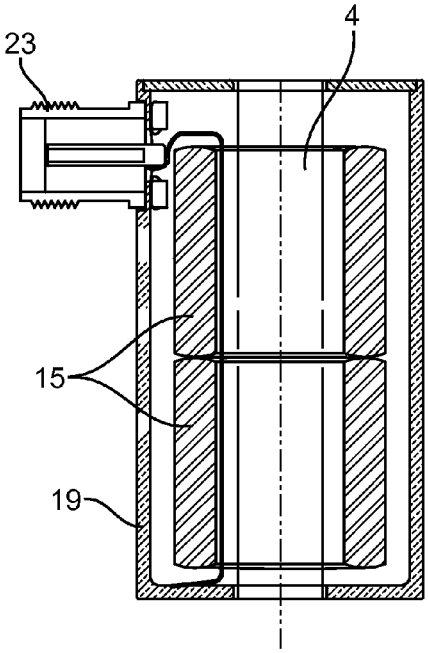

FIGS. 2L-2N show another embodiment of the disclosed antenna system with a toroidal magnetic core. Specifically, FIG. 2L illustrates a perspective view of the antenna device with an annular cover of the housing shown removed. FIG. 2M shows a top view of the antenna device, revealing the core configuration within the housing. FIG. 2N is a partial vertical cross-section view of the antenna device, revealing the core configuration within the housing.

FIG. 2K shows another vertical cross-section of the antenna system shown in FIG. 2I. Further, FIG. 2J shows a horizontal cross-sectional view of the antenna system shown in FIG. 2I. In one embodiment, the antenna system 10 comprises an RF current-sensing and current injecting antenna device for coupling RF energy, wherein the antenna device comprises an outer conducting non-magnetic housing 19, the magnetic core 15 having the central aperture 4, said core 15 insulated from said housing 19 via insulator 21. The antenna device further includes the first winding 17 wound about said core 15, said first winding having a first end receiving said RF energy and a second end, said first winding 17 insulated from said housing 19 between said first end and said second end. The conductor 12 is positioned within said aperture 4, wherein said conductor 12 has a length of at least 0.1 wavelength of said RF energy, wherein, in a transmitting mode said antenna device couples RF energy, created in an RF transmitter (not shown), to the conductor 12. In a receiving mode said antenna device couples RF energy, developed in the conductor 12 intercepting an RF field, to the input of an RF receiver (not shown). In the transmitting mode, the first winding 17 functions as a primary winding and the conductor 12 functions as a secondary winding. In the receiving mode, the first winding 17 functions as a secondary winding and the conductor 12 functions as a primary winding. In one embodiment, the antenna device is connected to a transceiver (not shown) for transmitting RF energy and receiving RF energy via the winding 17 and the conductor 12.

As noted, according to embodiments of the disclosed antenna system, a variety of geometries for the transformer are enabled, such as toroidal magnetic core, rectangular or square magnetic core, elliptical, etc.

Figure 2O:
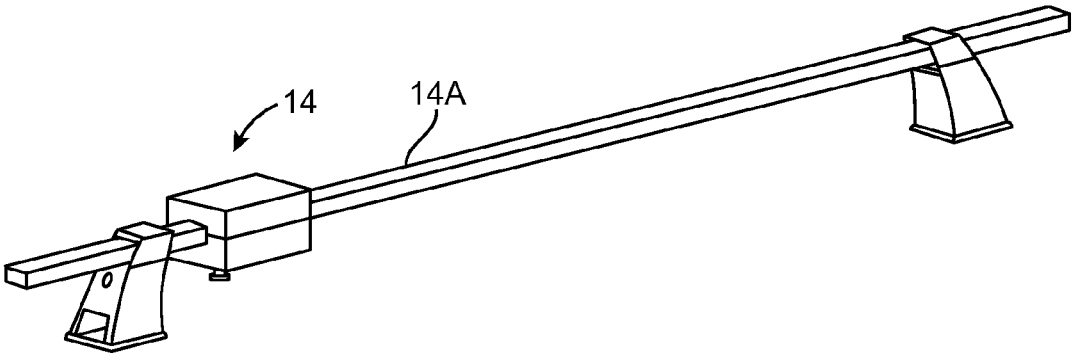
FIG. 2O shows an embodiment of the antenna system having a rectangular profile core coupled to a rectangular profile roof rack element for a vehicle.
Figure 2P:
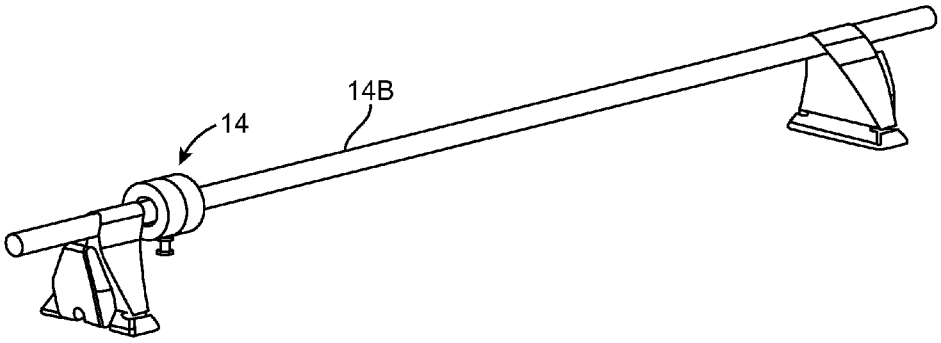
FIG. 2P shows an embodiment of the antenna system having a toroidal core profile coupled to a cylindrical profile roof rack element for a vehicle.

In one embodiment, the antenna device allows exploiting an existing structure such as a roof rack as antennas to reduce antenna system visibility compared to vehicles using the traditional whip antennas. FIG. 2O shows an embodiment of the antenna device 10 having a rectangular profile core coupled to a rectangular profile roof rack element 14A for a vehicle. The antenna device can be configured to fit around roof rack elements, or it can be used on custom shaped wires or antennas embedded into doors or windows (such as in a vehicle). The antenna system is transformer based and is configured for reduced loss when used for RF transmitting and increased sensitivity when used for RF receiving. Example approximate characteristics for the embodiment shown in FIG. 2O include:

Frequency range: 100 MHz to 400 MHz
Installation: Fixed aperture, non-split core
Internal diameter: 26 mm×34 mm of core aperture
Housing outer/external diameter: (L×W×H) 115 mm×57 mm×77 mm
Zt dBΩ: +30 dBΩ
Power Rating: <100 W PEP peak envelope power
Input Impedance: 50Ω
Voltage Standing Wave Ratio (VSWR): <4:1
Weight: 1.4 kg FIG. 2P shows an embodiment of the antenna device 14 having a toroidal core profile coupled to a cylindrical profile roof rack element 14B for a vehicle. In one embodiment, the antenna device allows exploiting existing structures such as roof racks as antennas to reduce its visibility compared to vehicles using the traditional whip antennas. The antenna system can be configured to fit around roof racks, elements, or it can be used on custom shaped wire antennas embedded into doors or windows. The antenna system is transformer based and is configured for reduced loss when used for RF transmitting and increased sensitivity when used for RF receiving. For example, approximate characteristics for the embodiment shown in FIG. 2P include:

Frequency range: 100 MHz to 400 MHz
Installation: Fixed aperture
Internal diameter: 33 mm of core aperture
Housing external diameter: 71 mm
Vertical height: 75 mm
Zt dBΩ: +32 dBΩ
Power Rating: <100 W
Input Impedance: 50Ω
Voltage Standing Wave Ratio (VSWR): <4:1
Weight: 0.8 kg In one embodiment of the antenna system 10, the electrically conducting structure 12 is a monopole, dipole or loop integrated with the transformer 14. This embodiment extends the bandwidth of the resulting dipole, monopole or loop. The material selection for the transformer and antenna (i.e., radiator) allows a sub-quarter wavelength transmit and receive operation.

In one embodiment, the disclosed antenna system provides a stealth apparatus for replacing conventional antennas which receive and transmit radio frequency energy from radio frequency transmitters and receivers. In one embodiment, the disclosed antenna system provides for the use of any conductor as a receiving and transmitting antenna 12, wherein essentially any electrical conductor or surface that is about 0.1 RF wavelengths or longer will receive or radiate RF energy.

Stealthy antennas are useful to support numerous wireless radio communications systems and signal intelligence systems on vehicles. Embodiments of the disclosed antenna system are suitable for stealth application according to a method disclosed herein. Stealthy antennas are required to support numerous wireless radio communications systems and signal intelligence systems on vehicles. The disclosed antenna device provides inductive coupling of RF signal to transmit and receive on a mobile vehicle.

According to an embodiment of a method disclosed herein, design of an embodiment of the antenna device as a clamp-on and fixed aperture transceiver probe intended for direct attachment to an existing platform (e.g., vehicle), is a function of the electromagnetic response of the platform. The transceiver probe performance is dependent on the impedance characteristics of the platform structure that the transceiver probe is mounted on and the orientation of the platform structure.

Embodiments of the antenna system disclosed herein provide an integrated device allowing control of the structural impedance and optimization of transceiver probe performance, to be embedded in various environments. The antenna system integrates the transceiver probe and a radiating structural element (e.g., conductor 12) to obtain a portable configuration. This eliminates the dependence on using an existing structural element (i.e., existing antenna).

In one embodiment, once the transmit power (based on longest transmission/receiving distance), desired frequency range, and receive sensitivity are identified, the appropriate location and topology of the antenna system 10 on a structure (e.g., mobile vehicle) can be determined. In one implementation for embedding the disclosed antenna system in a vehicle, the process to determine the location and topology is dependent on the type of vehicle and amount of stealth. The locations will be different depending on the type of vehicle. If a modest line-of-sight communication distance (radio horizon) is desired, the topology may be in the form of placing the transformer 14 in a vehicle sun visor. If longer radio horizons are required, a roof rack or monopole configuration may be used for the transformer 14.

A monopole antenna is a radio antenna consisting of a straight rod-shaped conductor, mounted on a conductive surface, called a ground plane. The driving signal from the transceiver is applied, or for receiving antennas the output signal to the receiver is taken, between the lower end of the monopole and the ground plane. One side of the antenna feedline is attached to the lower end of the monopole, and the other side is attached to the ground plane. This is in contrast with a dipole antenna which consists of two identical rod conductors, with the signal from the transmitter applied between the two halves of the antenna.

Both applications of the transceiver probe to the sun visor, roof rack or inside a cross member, can be fabricated such that the transceiver probe is not visible. This makes them ideal for signal intelligence applications.

Figure 3:
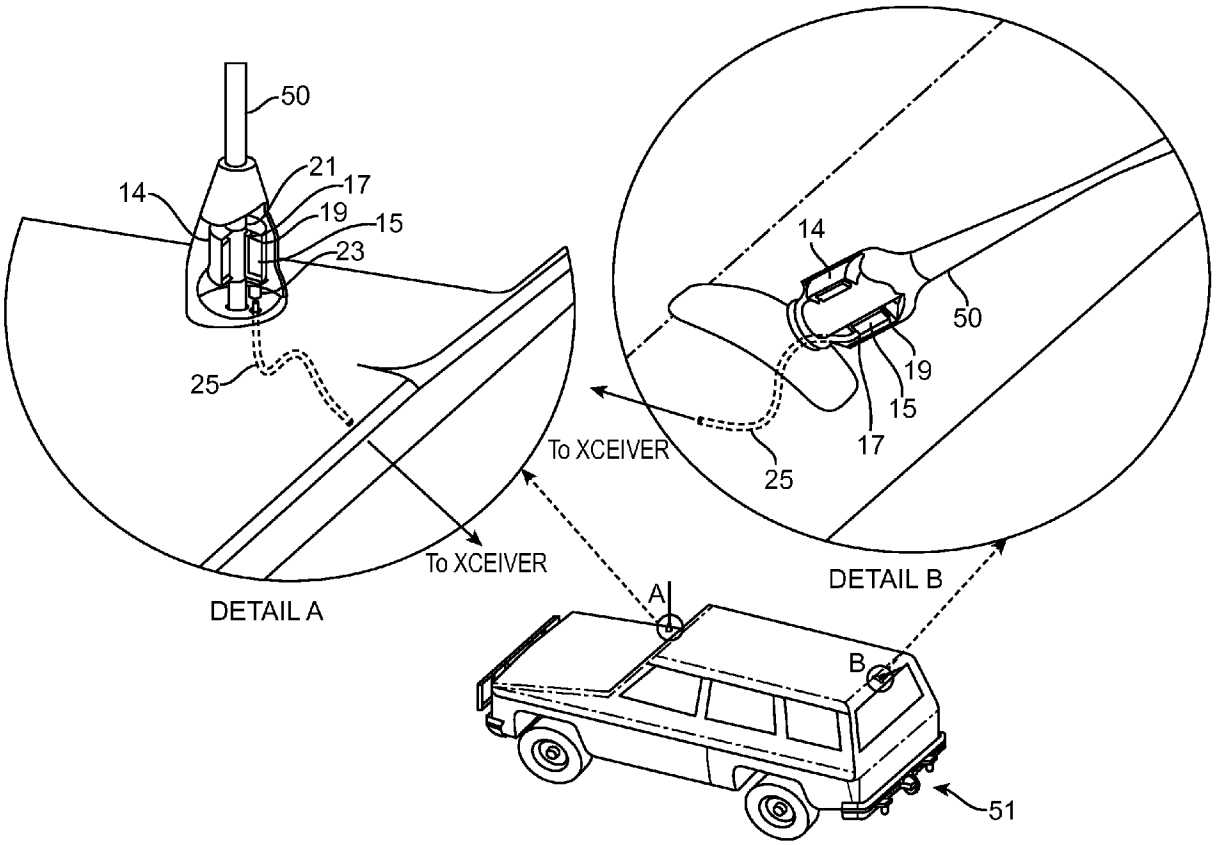
FIG. 3 illustrates an embodiment of the disclosed antenna system for embedding in an existing vehicle antenna.

FIG. 3 illustrates an embodiment of the disclosed antenna device 14 as a coupler for embedding in an existing radio antenna 50 of a vehicle 51, wherein DETAIL A shows embedding in a front radio antenna and DETAIL B shows embedding in a rear radio antenna. The antenna device can be connected to an RF transceiver (XCEIVER) in the vehicle using a cable 25 via an RF connector 23 of the antenna device. The existing radio antenna 50 comprises a electrical conductor 12 placed within the aperture of the core 15, as described herein.

Figure 4:
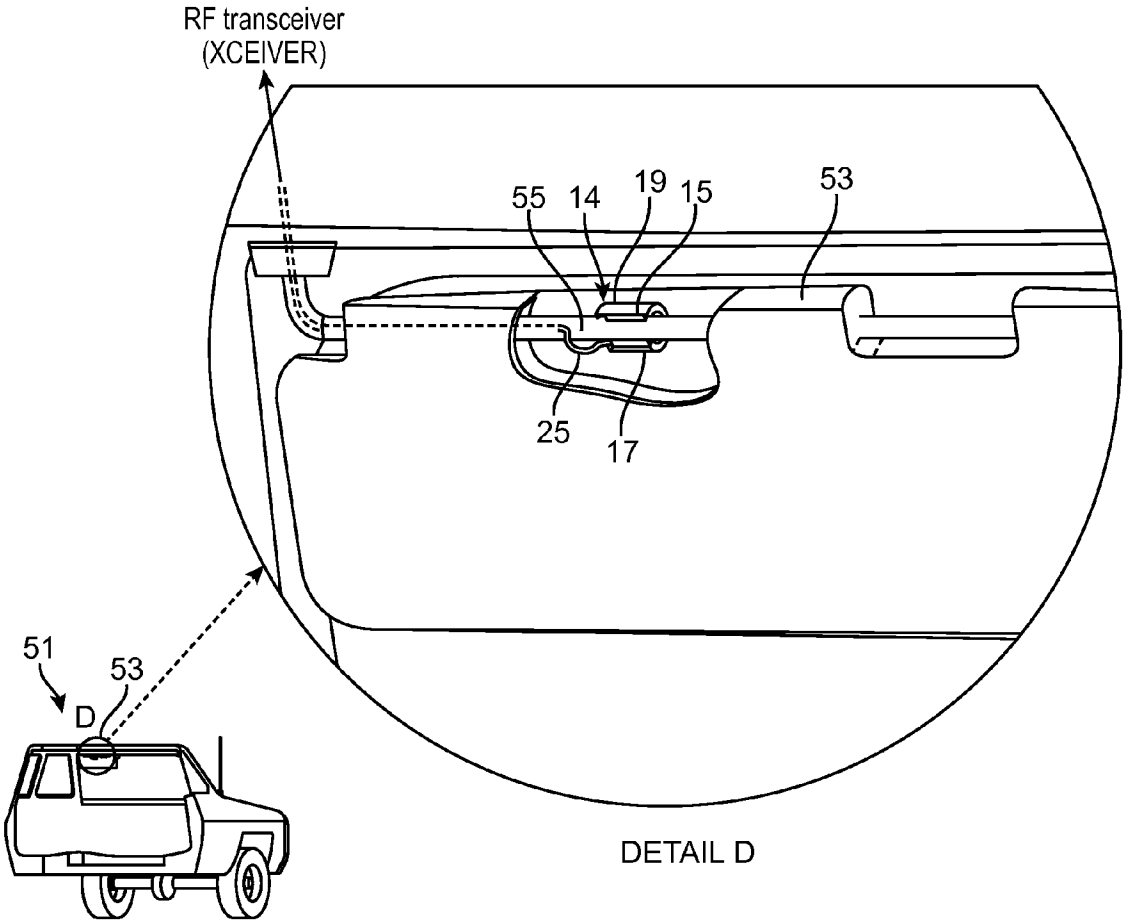
FIG. 4 illustrates an embodiment of the disclosed antenna system for embedding in a vehicle sun visor.

FIG. 4 illustrates an embodiment of the disclosed antenna device 14 as a coupler for embedding in an existing sun visor structure 53 of a vehicle 51. As shown in DETAIL D a conductive sun visor support 55 is placed in the aperture of the core 15. The antenna system is connected to an RF transceiver (XCEIVER) in the vehicle using a cable 25. The existing electrically conductive sun visor support 55 comprises an electrical conductor 12 placed within the aperture of the core 15, as described herein.

Figure 5:
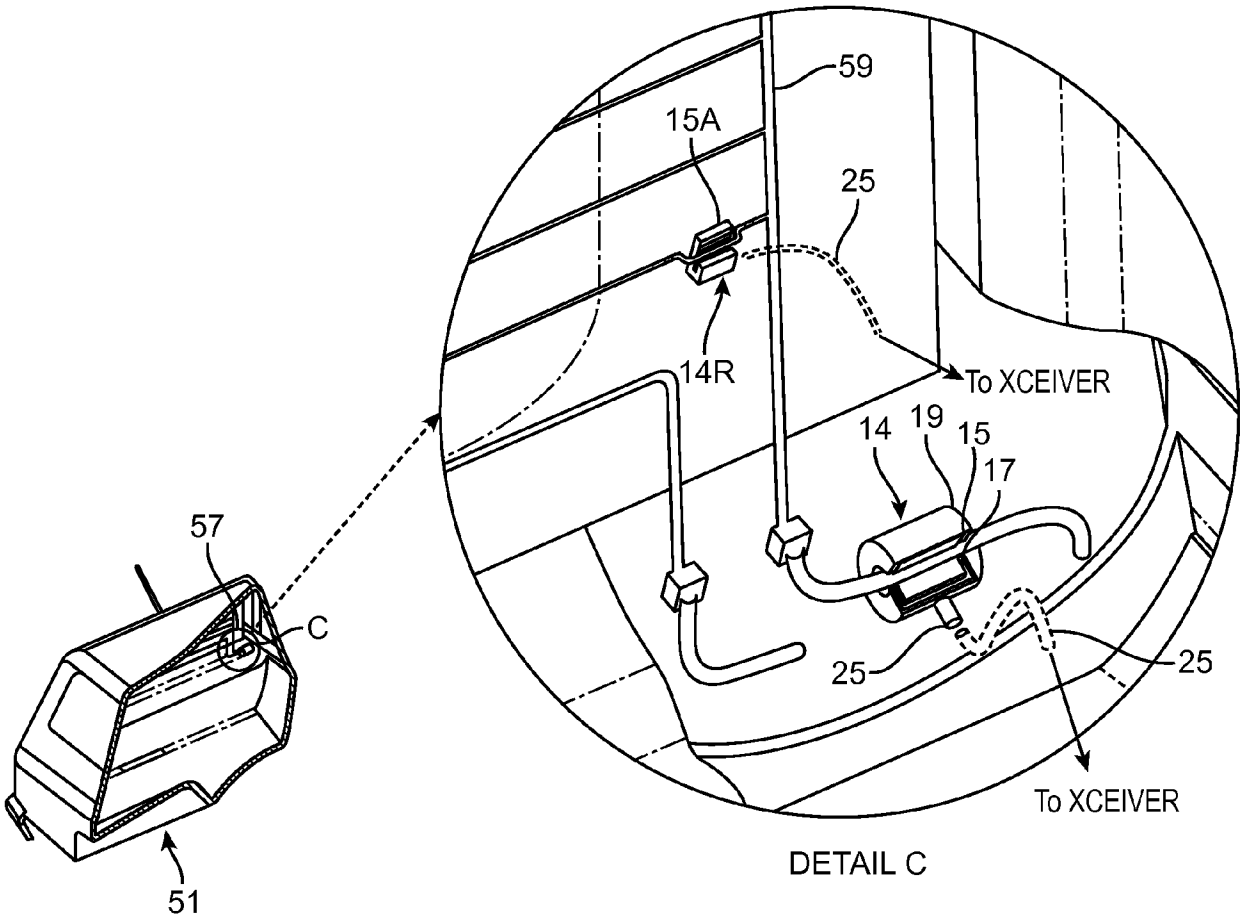
FIG. 5 illustrates an embodiment of the disclosed antenna system for embedding in existing vehicle rear window heating element wiring.

FIG. 5 illustrates an embodiment of the disclosed antenna device 14 as a coupler for embedding in existing rear window heating element wiring structure 57 of vehicle 51. As shown in DETAIL C electrically conductive heat element wiring 59 is placed in the aperture of the core 15. The antenna system is connected to an RF transceiver (XCEIVER) in the vehicle using a cable 25. The existing electrically conductive heat element wiring 59 comprises an electrical conductor 12 placed within the aperture 4 of the core 15, as described herein. FIG. 5 shows a further antenna device 14R with a rectangular core 15A, according to another embodiment of the present invention, embedded on another segment of the heating element wiring 59 of the vehicle 51, and connected to a transceiver via cable 25. The antenna device 14A and the antenna device 14 may have similar or different characteristic based on requirements such as frequency range.

Figure 6:
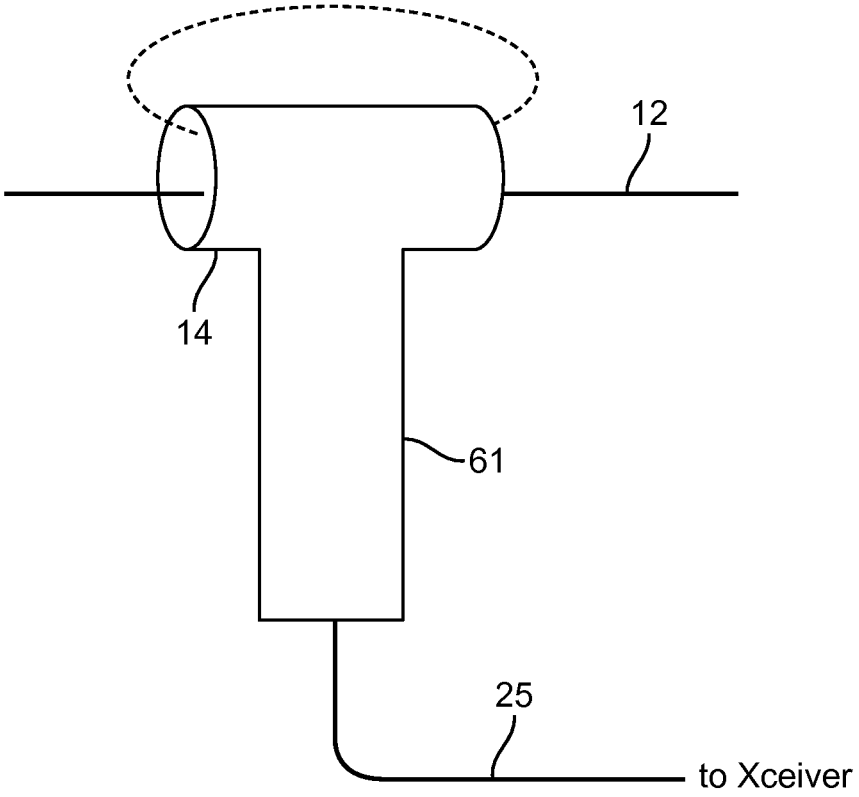
FIG. 6 illustrates an embodiment of the disclosed antenna system as a coupler/antenna ensemble as a hand unit.

FIG. 6 illustrates an embodiment of the disclosed antenna device 14 as a coupler/antenna ensemble as a hand unit, wherein an electrical conductor 12 is placed within aperture of the core the antenna device 10, which is provided with a handle 61.

Figure 7:
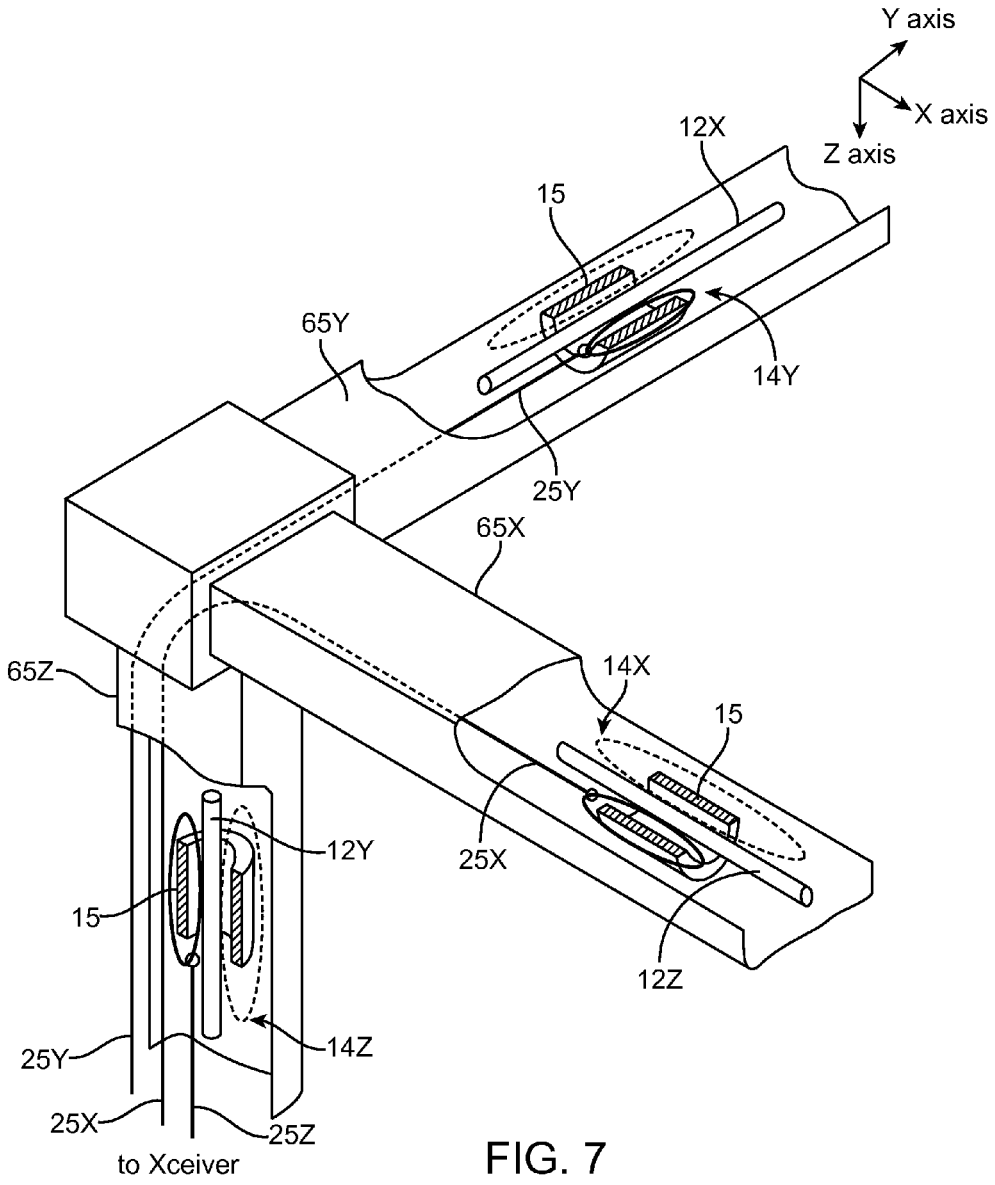
FIG. 7 illustrates an embodiment of the disclosed antenna system as a series of multiple coupler/custom antenna elements in roof rack configuration for a vehicle, for optional transmit/receive capability and direction finding.

In one implementation, the performance of the transceiver/receiver can be essentially optimized by combining signals from multiple probes mounted on orthogonal axes, as described in further detail below. FIG. 7 illustrates an embodiment of the disclosed antenna system 10 as a series of multiple coupler/custom antenna devices in roof rack configuration for a vehicle, for optional transmit/receive capability and direction finding. In the embodiment shown in FIG. 7, a series of three coupler antenna devices 14X, 14Y, 14Z are embedded in three electrically non-conductive roof structures 65X, 65Y, 65Z, respectively. The roof structures 65X, 65Y, 65Z are oriented in a three dimensional Cartesian coordinate system, wherein electrical conductors 12X, 12Y, 12Z in the roof structures 65X, 65Y, 65Z are disposed within the aperture of the core 15 of each of the coupler antenna devices 14X, 14Y, 14Z, respectively. The roof structures 65X, 65Y, 65Z are shown with partial cutaways to reveal the elements embedded therein for stealth. The antenna devices 14X, 14Y and 14Z are shown by vertical cross-section to illustrate placement of the electrical conductors 12X, 12Y and 12Z in the core apertures.

The roof structures 65X, 65Y, 65Z in the example comprise rectilinear members which house the electrical conductors 12X, 12Y, 12Z and antenna devices 14X, 14Y, 14Z, wherein electrical cables 25X, 25Y and 25Z, respectively, connect the antenna devices 14X, 14Y, 14Z to a transceiver, allowing direction finding. This configuration overcomes directionality problems of single probe antennas. The number and placement of antenna devices as transceiver probes 14 depends on the structure of the roof rack the antenna is placed on.

As such, using multiple antenna devices 14 as RF couplers, allows direction finding using appropriate direction finding transceiver using radio direction finding techniques known to those skilled in the art. Similarly, the antenna devices 14 allow for transmitting and receiving wireless e-mail using appropriate transmit and receiving electronics systems known to those skilled in the art.

According to an embodiment, a process of integrating the disclosed antenna system into a vehicle, such as for stealth purposes, involves determining how to embed at least one antenna device 14 as a transceiver probe in e.g. an existing roof rack of vehicle. An alternative is to provide a custom roof rack that resembles an existing roof rack including one or more antenna devices 14X, 14Y, 14Z (for stealth such that the observer does not realize the vehicle has communication antennas) that provides better sensitivity and uniform detection capability. Each antenna device 14X, 14Y, 14Z is placed on different platforms (e.g., locations) on the vehicle in a stealthy fashion by hiding them from view, and then RF communication via the antenna system is monitored via monitoring equipment as known to those skilled in the art. The process is continued (such as moving one or more of the antenna devices 14X, 14Y, 14Z to different location in the vehicle) until a desired performance of the antenna system is achieved while maintaining stealth as desired.

The desired location of the disclosed antenna device on a vehicle (e.g., in terms of RF transmission/reception performance) depends on factors including the shape and materials of the vehicle. For example, if the vehicle is a sedan, a sports utility vehicle (SUV), or a truck then the ideal location of the disclosed antenna device 14 on the vehicle will be different due to materials and shape of the vehicle. For example, there will be reflections of RF energy from the vehicle surfaces and locations on the vehicle where there is poor RF signal availability. The most appropriate location on a vehicle for both transmit and receive operation is determined in an iterative process of placing the antenna device on various locations on a vehicle to achieve desired results.

Figure 8:
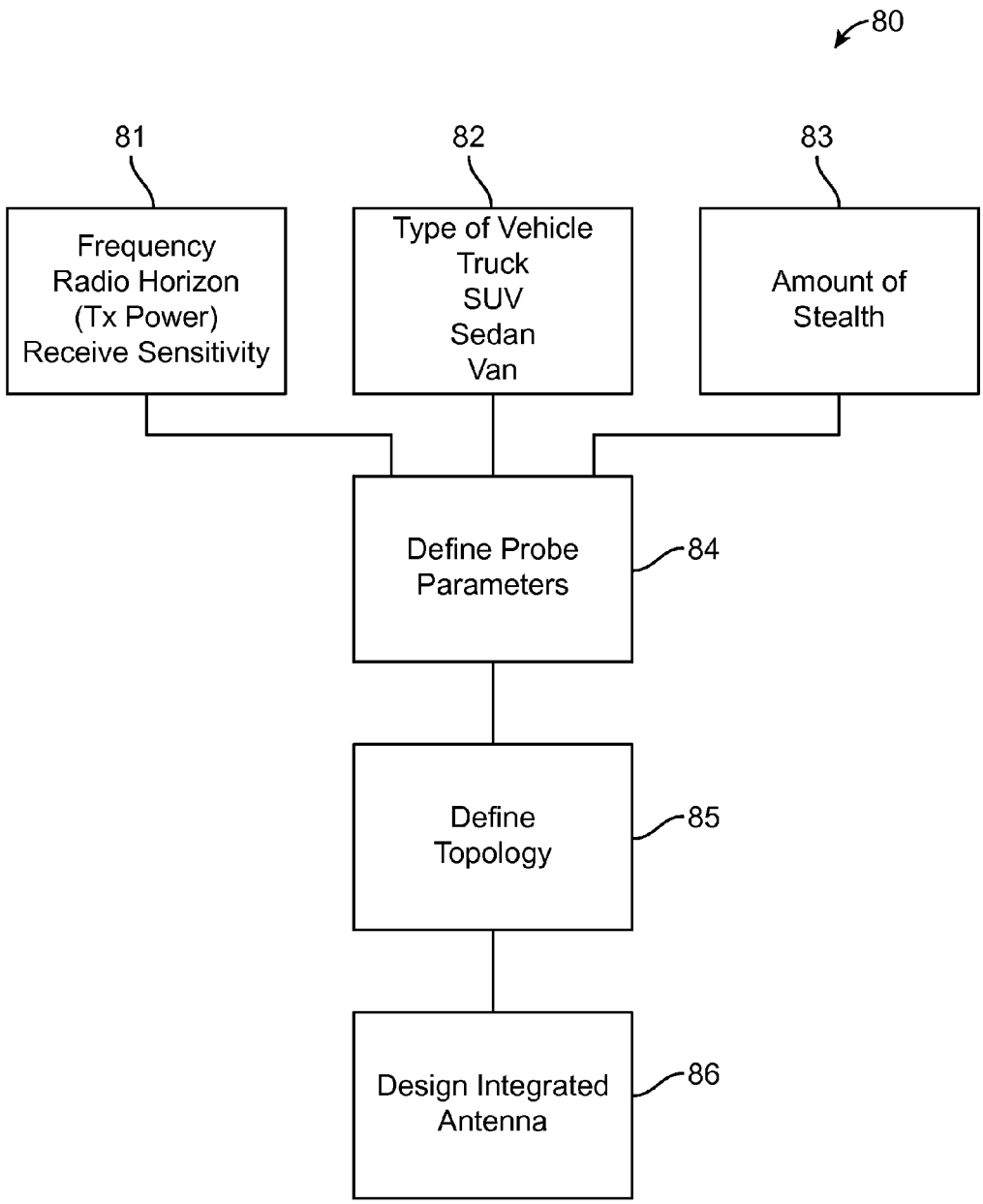
FIG. 8 illustrates a method for configuration, topology determination and mounting for the disclosed antenna system based on application, according to one embodiment.

FIG. 8 illustrates a mounting method and process 80 for configuration and topology determination for the disclosed antenna system based on application, according to one embodiment. Process 80 comprises:

- Step 81: Determine desired performance such as frequency radio horizon (transmission power) and receive sensitivity;
- Step 82: Determine type of structure for embedding the antenna device (e.g., vehicle such as truck, SUV, sedan, van);
- Step 83: Determine amount stealth desired. This involves how distinguishable the antenna system is to a human observer as an RF communication system.
- Step 84: Define antenna device 14 (antenna probe) parameters including one or more of:
  - Communication only;
  - Direction finding only;
  - Frequency range;
  - Transmit/receive power;
  - Weight limit;
  - Environmental requirements (e.g., shock, vibration, thermal, moisture, dust, etc.);
- Step 85: Define topology for the antenna system for the structure, including one or more of:
  - Ideal location on vehicle;
    - Alternate location;
  - Type of vehicle;
  - Other location requirements (e.g., on a strut on the underside of the vehicle);
- Step 86: Design integrated antenna for the structure, including the steps of:
  - Mount antenna device by coupling to a conductor of the structure in the core aperture, and test antenna device functionality on vehicle (e.g., using a transceiver);
  - If acceptable, then proceed to final design and production;
  - If not acceptable, redesign antenna device or antenna device ensemble (e.g., repeat process using test data to change the antenna device features including using a different ferromagnetic core material, changing the core shape, increasing core size to add more core material, etc);
  - Retest;
  - Repeat process until testing is satisfactory;
  - Proceed to final design and production.

Although the examples provided herein are directed to mounting one or more of the antenna devices 14 on a vehicle, the disclosed antenna system and mounting method are not limited to vehicles, and are useful in other applications and structures as those skilled in the art will recognize.

These embodiments can be used for communication, direction finding, signal intelligence, wireless data transmission (e-mail and file transfer). The direction finding requires multiple devices connected via an RF coupler to appropriate direction finding receiver. Similarly Wireless e-mail requires appropriate transmitting and receiving electronics systems.

While certain exemplary embodiments of a stealth radio frequency antenna have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A radio frequency (RF) current-sensing and current injecting antenna device for coupling RF energy, said antenna device comprising:

an outer conducting non-magnetic housing;

a magnetic core having a central aperture, said core insulated from said housing; and a first winding wound about said core, said first winding having a first end receiving said RF energy and a second end, said first winding insulated from said housing between said first end and said second end, wherein a conductor is positioned within said aperture, and said conductor has a length of at least 0.1 wavelength of said RF energy;

wherein in a transmitting mode said antenna device couples RF energy, created in an RF transmitter, to the conductor;

wherein in a receiving mode said antenna device couples RF energy, developed in the conductor intercepting an RF field, to an input of an RF receiver; and the housing and core are selectively positioned on said conductor to provide desired visual stealth based on the spatial location of the conductor, while allowing RF communication with the antenna device.

2. The antenna device of claim 1, wherein:

in the transmitting mode, the first winding functions as a primary winding and the conductor functions as a secondary winding; and in the receiving mode, the first winding functions as a secondary winding and the conductor functions as a primary winding.

3. A method of mounting an antenna device on a structure for radio frequency (RF) communication, comprising:

determining RF performance requirements for RF communication via an RF antenna device;

determining physical attributes of said structure for mounting said antenna device;

providing said antenna device based on said RF performance requirements;

determining a desired visual stealth for said antenna device on said structure;

determining topology of said antenna device based on said physical attributes to satisfy said performance requirements, wherein determining topology of said antenna device is further based on said desired amount of visual stealth while allowing RF communication via the RF antenna device meeting said RF performance requirements; and mounting said antenna device on said structure based on said topology.

4. The method of claim 3, wherein said antenna device comprises an RF current-sensing and current injecting antenna device for coupling RF energy to at least an electrically conductive portion of said structure.

5. The method of claim 4, wherein said antenna device comprises:

an outer conducting non-magnetic housing;

a magnetic core having a central aperture, said core insulated from said housing; and a first winding wound about said core, said first winding having a first end receiving said RF energy and a second end, said first winding insulated from said housing between said first end and said second end, wherein a conductor is positioned within said aperture, and said conductor has a length of at least 0.1 wavelength of said RF energy;

wherein in a transmitting mode said antenna device couples RF energy, created in an RF transmitter, to the conductor;

wherein in a receiving mode said antenna device couples RF energy, developed in the conductor intercepting an RF field, to an input of an RF receiver; and the housing and core are selectively positioned on said conductor to provide desired visual stealth based on the spatial location of the conductor, while allowing RF communication with the antenna device.

6. The method of claim 5, wherein:

in the transmitting mode, the first winding functions as a primary winding and the conductor functions as a secondary winding; and in the receiving mode, the first winding functions as a secondary winding and the conductor functions as a primary winding.

7. The antenna device of claim 1, wherein:

the antenna device is a clamp-on device comprising a clamp including: a hinged housing and split core for opening and positioning the housing and core around said conductor, and a latch for closing and clamping the housing and core around said conductor; and the housing and core are selectively positioned on said conductor to provide visual stealth based on the spatial location of the conductor.

8. The antenna device of claim 1, wherein said conductor is disposed in a vehicle.

9. The antenna device of claim 8, wherein said conductor comprises at least one of: metallic wire, rod, bar, slab, strip, and surface, of the vehicle.

10. The antenna device of claim 8, wherein said conductor is disposed as a roof rack structure of the vehicle.

11. The antenna device of claim 8, further comprising a coupler for disposing the core within the vehicle antenna support structure to provide visual stealth, such that the vehicle antenna as a conductor is positioned within said core aperture.

12. The antenna device of claim 8, wherein said conductor is disposed into at least one door of the vehicle.

13. The antenna device of claim 8, wherein said conductor is disposed as a sun visor support of the vehicle, and the housing is positioned on the conductor to provide visual stealth.

14. The antenna device of claim 8, wherein said conductor is disposed as a cross member of the vehicle structure, and the housing is positioned on the conductor to provide visual stealth.

15. The antenna device of claim 8, wherein said conductor is disposed as a window heating element wiring structure of the vehicle, and the housing is positioned on the conductor to provide visual stealth.

16. The antenna device of claim 1, wherein the core has a spatial profile based on shape and size of the conductor, for receiving the conductor therein.

17. The antenna device of claim 16, wherein the core comprises a rectangular profile core.

18. The antenna device of claim 17, wherein the core comprises a rectangular core comprising multiple layered or staggered rectangular elements within the housing.

19. The antenna device of claim 1, wherein:

the antenna device comprises a fixed aperture core selected based on the impedance characteristics of the conductor to meet one or more of: desired RF transmit power, desired RF frequency range, and receive sensitivity; and the housing containing the core is positioned on the conductor based on spatial orientation and location of the conductor to provide desired visual stealth.

20. The antenna device of claim 19, wherein the antenna device provides sub-quarter wavelength transmit and receive operation.

21. An antenna system comprising:

a plurality of radio frequency (RF) current-sensing and current injecting antenna devices disposed in a structure, wherein each antenna device comprises an outer conducting non-magnetic housing and a magnetic core having a central aperture, said core insulated from said housing;

wherein each antenna device housing is placed on a respective electrical conductor in the structure, the electrical conductor being disposed within the core aperture of that antenna device, and wherein the housing containing each core is selectively positioned on the respective electrical conductor based on spatial orientation and location of the electrical conductor to provide desired visual stealth for the antenna system; and wherein each core is selected based on the impedance characteristics of the respective electrical conductor to meet one or more of: desired RF transmit power, desired RF frequency range, and receive sensitivity while allowing RF communication with the antenna system.

22. The antenna system of claim 21, wherein each electrical conductor is an essentially elongate electrical conductor, and the electrical conductors are in transverse orientation with respect to one another.

23. The antenna system of claim 22, wherein the structure comprises a vehicle structure.

24. The antenna system of claim 23, wherein the vehicle structure comprises a vehicle roof structure.

25. The antenna system of claim 23, wherein the vehicle structure comprises cross members of the vehicle.

26. The antenna system of claim 22, said antenna devices are selectively positioned on said respective electrical conductors as coupler antenna devices, embedded in electrically non-conductive structures for visual stealth, to provide RF direction finding.

* * * * *